US008303317B1

(12) United States Patent
Gao et al.

(10) Patent No.: US 8,303,317 B1
(45) Date of Patent: Nov. 6, 2012

(54) CONNECTOR ASSEMBLY

(75) Inventors: Lei Gao, Guang-Dong (CN); Bing-Tao Yang, Guang-Dong (CN); Yin-Lung Wu, New Taipei (TW); Ming-Chiang Chen, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/251,200

(22) Filed: Sep. 30, 2011

(51) Int. Cl.
*H01R 12/00* (2006.01)

(52) U.S. Cl. ..... 439/83; 439/660; 439/74

(58) Field of Classification Search ..... 439/74, 439/83, 660
See application file for complete search history.

(56) References Cited

U.S. PATENT DOCUMENTS 5,667,393 A * 9/1997 Grabbe et al. ..... 439/660
5,921,787 A * 7/1999 Pope et al. ..... 439/74
6,010,370 A * 1/2000 Aihara et al. ..... 439/660
6,471,539 B1 * 10/2002 Yu ..... 439/489
6,623,308 B2 * 9/2003 Ono ..... 439/680
6,875,027 B2 * 4/2005 Ye et al. ..... 439/74
6,905,345 B2 * 6/2005 Zhang ..... 439/74
7,559,805 B1 * 7/2009 Yi et al. ..... 439/660
2005/0059271 A1 * 3/2005 Zhang ..... 439/74

* cited by examiner

*Primary Examiner* — Briggitte R Hammond
(74) *Attorney, Agent, or Firm* — Cheng-Ju Chiang

(57) ABSTRACT

A connector assembly includes a socket connector, and a plug connector including a plug housing and plug terminals disposed in the plug housing and each having a contact portion projected sideward out of the plug housing. The socket connector includes a socket housing defining an insertion space, plug terminals disposed in the socket housing and contact pads embedded in two opposite inner sidewalls of the insertion space to connect with the plug terminals and exposed in the insertion space. Two end edges of the inner sidewalls of the insertion space are designed with two arc-shaped guiding surfaces. A bottom of each contact pad is bent and embedded in the inner sidewall to realize a smooth connection of the contact pad and the guiding surface so as to guide the contact portions to be inserted into the insertion space along the guiding surfaces and electrically contact with the contact pads.

6 Claims, 7 Drawing Sheets

CONNECTOR ASSEMBLY

BACKGROUND OF THE INVENTION

1. Field of the Invention

The present invention generally relates to a connector assembly, and more particularly to a connector assembly used for charging a cell phone.

2. The Related Art

Currently, more and more people use a cradle charger to charge for a battery of a cell phone. The cell phone generally includes a socket connector adapted to be electrically engaged with a plug connector assembled in the cradle charger so as to charge the cell phone in the cradle charger. The socket connector includes a socket housing, a pair of socket terminals and contact pads. The socket housing defines an insertion space vertically penetrating through a bottom thereof. The socket terminals are mounted in the socket housing. Two inner sidewalls of the insertion space are concaved oppositely to form two embedding grooves. The contact pads are embedded in the two embedding grooves and electrically connected with the socket terminals. The plug connector includes a plug housing, and a pair of plug terminals disposed in the plug housing and projecting out of two sides of the plug housing to contact with the contact pads. However, when the plug housing together with the plug terminals is inserted into the insertion space of the socket connector, two mating end edges of the contact pads are exposed in the insertion space and interspaces are formed between the two mating end edges of the contact pads and two inner ends of the two embedding grooves. As a result, the mating peripheral edges of the socket housing are apt to be damaged and the mating end edges of the contact pads are apt to be curled to cause a poor connection with the plug terminals in the process of inserting the plug connector into the insertion space of the socket connector.

SUMMARY OF THE INVENTION

An object of the present invention is to provide a connector assembly which includes a socket connector adapted for being soldered on a first printed circuit board, and a plug connector adapted to be engaged with the socket connector and soldered on a second printed circuit board. The socket connector includes a socket housing, at least two plug terminals and two contact pads. The socket housing defines an insertion space at a lower portion thereof. At least two embedding grooves are defined in two opposite inner sidewalls of the insertion space and communicating with the insertion space. A top of the embedding groove penetrates upward through a top of the socket housing and a bottom of the embedding groove is deeply curved into the corresponding inner sidewall of the insertion space. The top of the socket housing defines at least two first terminal grooves connected with the tops of the embedding grooves respectively. Two bottom edges of the two opposite inner sidewalls of the insertion space are designed with two arc-shaped guiding surfaces. The socket terminals are received in the first terminal grooves of the socket housing with first soldering portions thereof projecting beyond a front of the socket housing to be soldered on the first printed circuit board. At least two contact pads are inserted into the embedding grooves of the socket housing and face-to-face exposed in the insertion space, with a top end of each contact pad being fastened in the top of the corresponding embedding groove to electrically contact with the socket terminal, and a bottom end of each contact pad being bent to be embedded in the bottom of the embedding groove so as to realize a smooth connection of the contact pad and the guiding surface. The plug connector includes a plug housing and at least two plug terminals. The plug housing includes a base board. A top of the base board protrudes upward to form an insertion head defining at least two second terminal grooves vertically penetrating through the base board, and further oppositely passing through two opposite sides of the insertion head. The plug terminals are received in the second terminal grooves. Each of the plug terminals has a second contact portion arched outward to elastically project sideward out of the second terminal groove and a second soldering portion projected under the base board to be soldered on the second printed circuit board, the second contact portion together with the insertion head being inserted into the insertion space of the socket housing along the guiding surfaces to electrically contact with the contact pads.

As described above, the bottoms of the contact pads are embedded in the curved bottoms of the embedding grooves to make the contact pads smoothly connected with the guiding surfaces so as to guide the second contact portions together with the insertion head to be inserted into the insertion space successfully and steadily along the guiding surfaces. Furthermore, the contact pads exposed in the insertion space have the longer contact distances to contact with second contact portions. So a better electrical connection is formed between the socket connector and the plug connector to realize a charge for the cell phone by virtue of the cradle charger.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
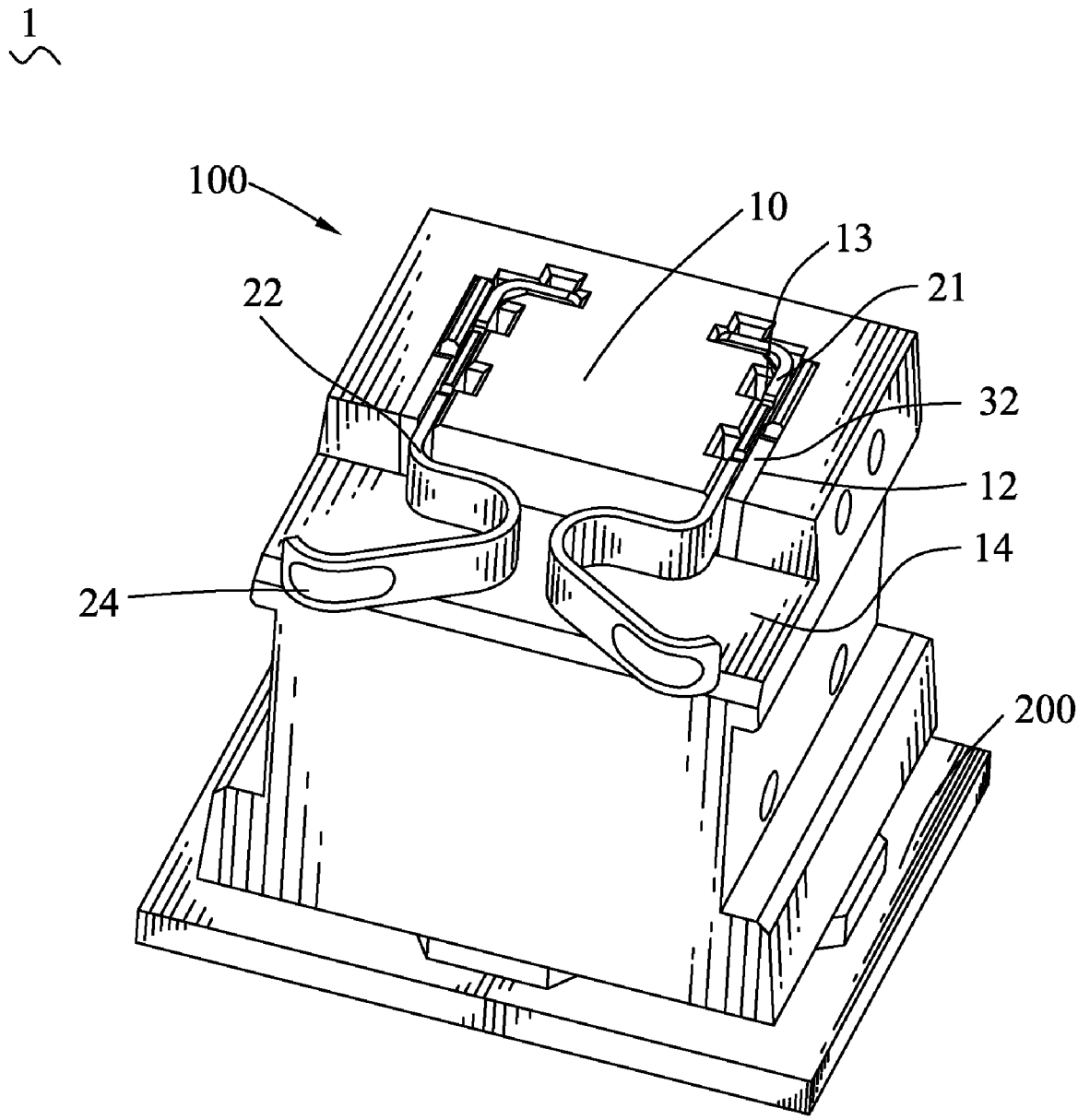
FIG. 1 is a perspective view of a connector assembly in accordance with an embodiment of the present invention.
Figure 2:
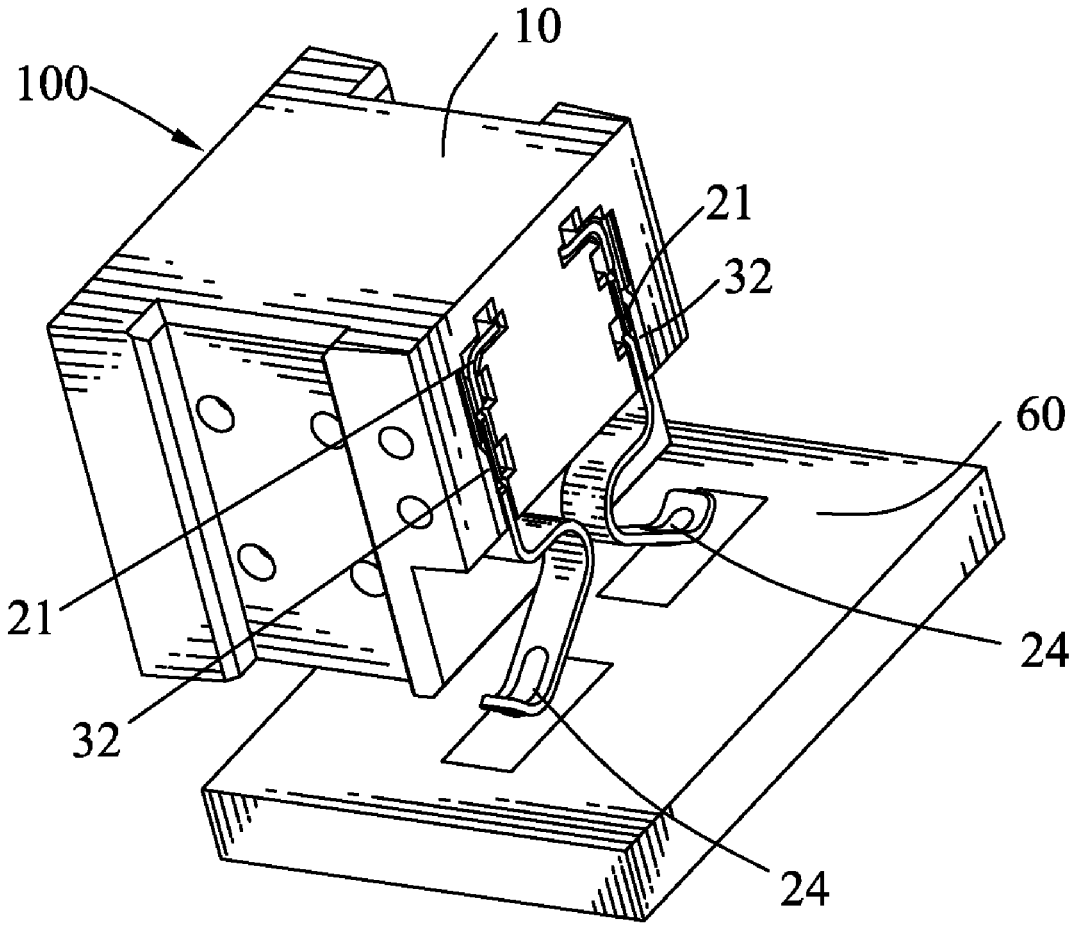
FIG. 2 is a perspective view of a socket connector of the connector assembly of FIG. 1, wherein the socket connector is soldered on a first printed circuit board of a cell phone.

With reference to FIGS. 1-6, a connector assembly 1 in accordance with the present invention is shown. The connector assembly 1 includes a socket connector 100 adapted for being soldered on a first printed circuit board 60 of a cell phone (not shown), and a plug connector 200 mounted to a holder 70 and soldered on a second printed circuit board 80 of a cradle charger (not shown). The socket connector 100 includes a socket housing 10, a pair of socket terminals 20 and contact pads 30. The plug connector 200 generally includes a plug housing 40 and a pair of plug terminals 50.

Referring to FIG. 1, FIG. 2, FIG. 3 and FIG. 7, the socket housing 10 is of a substantial rectangular shape. A middle of a lower portion of the socket housing 10 is cut off to form a trapezoid insertion space 11. Two bottom portions of two opposite inner sidewalls of the insertion space 11 are smoothly bent oppositely to form two arc-shaped guiding surfaces 111. The two opposite inner sidewalls of the insertion space 11 define two embedding grooves 12 communicating with the insertion space 11 and located above the guiding surfaces 111. A side of a top of the embedding groove 12 penetrates through a top wall of the insertion space 11 and a bottom of the embedding groove 12 is deeply curved into the corresponding inner sidewall of the insertion space 11. A rear side of a top of the top wall of the insertion space 11 defines two L-shaped first terminal grooves 13 disposed face to face along a transverse direction. An outer side of a longitudinal portion of each first terminal groove 13 is connected with the top of the embedding groove 12. A front side of the top of the top wall of the insertion space 11 is cut off to form a passage 14 communicating with the first terminal grooves 13.

Figure 3:
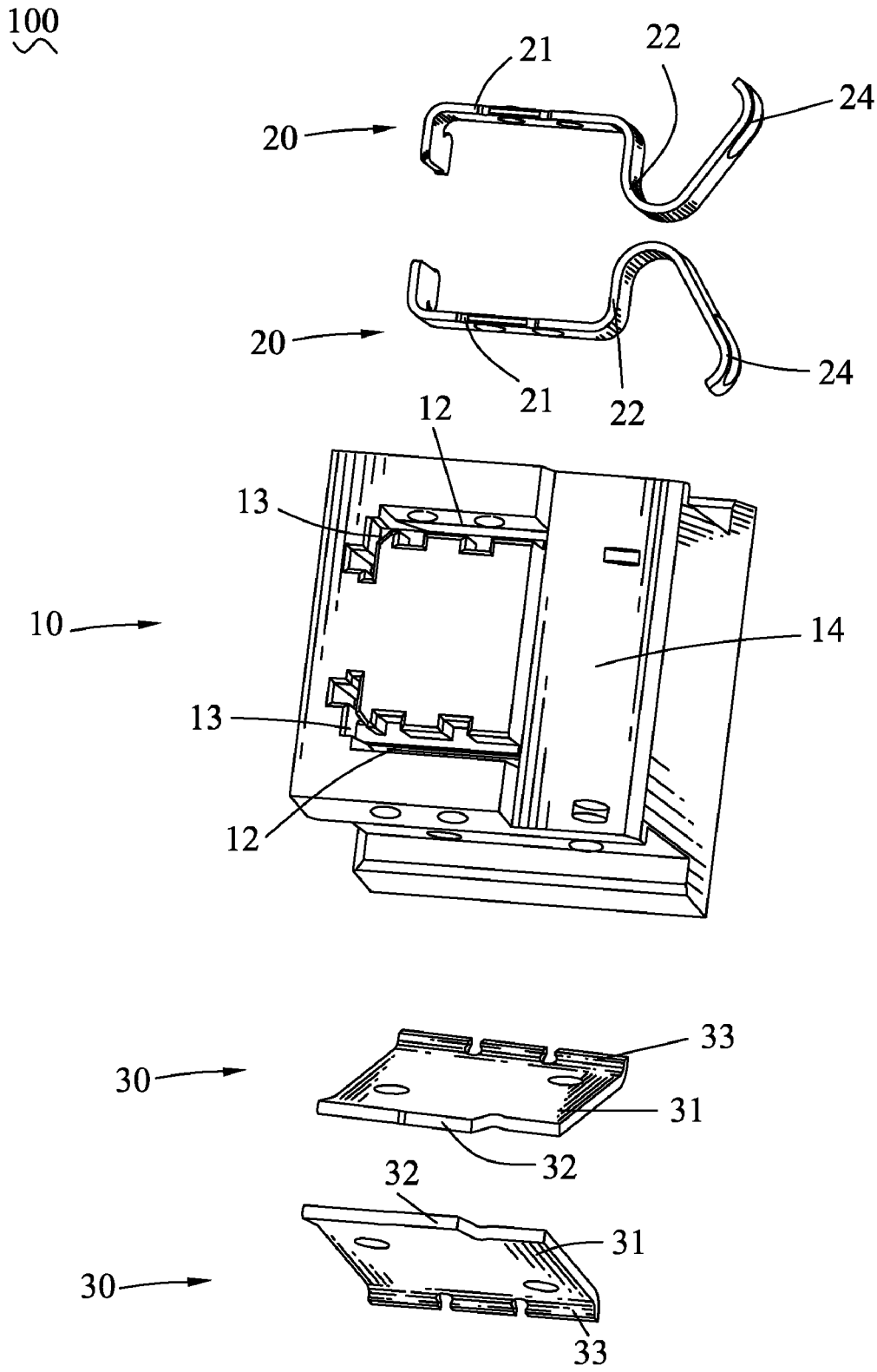
FIG. 3 is an exploded view of the socket connector of FIG. 2.

With reference to FIG. 3, each socket terminal 20 has an L-shaped first base portion 21 including a long arm and a short arm perpendicular to one end of the long arm. A substantial V-shaped elastic arm 22 is connected with the other end of the long arm of the first base portion 21. A free end of the elastic arm 22 is curved rearward to form a first soldering portion 24.

With reference to FIG. 3, each contact pad 30 of a plate shape includes a base plate 31. A top of the base plate 31 extends upward to form a contact piece 32. A bottom of the base plate 31 is bent sideward to form a fastening piece 33.

Referring to FIG. 1, FIG. 2, FIG. 3, FIG. 7 and FIG. 8, in assembly, the two contact pads 30 are inserted in the embedding grooves 12 of the socket housing 10, with the base plates 31 of the contact pads 30 being disposed in the embedding grooves 12 to be face-to-face exposed in the insertion space 11 and in one way of being slightly inclined opposite to each other from top to bottom to facilitate an insertion of the plug connector 200, the contact piece 32 of each contact pad 30 being fastened in the top of the embedding groove 12, and the fastening piece 33 of each contact pad 30 being bent to be embedded in the bottom of the embedding groove 12 so as to realize a smooth connection of the contact pad 30 and the guiding surface 111. The first base portions 21 of the socket terminals 20 are secured in the two first terminal grooves 13 to electrically contact with the contact pieces 32. The elastic arms 22 are located in the passage 14. The first soldering portions 24 are projected beyond a front of the socket housing 10 to be soldered on the first printed circuit board 60 of the cell phone.

Referring to FIG. 4, FIG. 5, FIG. 9 and FIG. 10, the plug housing 40 has a rectangular base board 41. A middle of a top of the base board 41 extends upward to form a connecting board 42. A middle of a top of the connecting board 42 protrudes upward to form a trapezoid insertion head 43 seen from a front view. The insertion head 43 defines two symmetrical second terminal grooves 44 vertically penetrating through the connecting board 42 and the base board 41, and transversely passing through two middles of two opposite sides of the insertion head 43. A lower portion of the second terminal groove 44 is wider than an upper portion of the second terminal groove 44. The lower portion of the second terminal groove 44 is acted as a receiving groove 441 and the upper portion of the second terminal groove 44 is acted as a fastening groove 442. Two rear portions of a front sidewall and a rear sidewall of the fastening groove 442 protrude face to face to form two blocking portions 4421 to define a first fastening groove 4422 between the two blocking portions 4421 and an inner sidewall of the fastening groove 442, and a second fastening groove 4423 between the two blocking portions 4421 and two sides of the outer sidewall of the second terminal groove 44.

Figure 5:
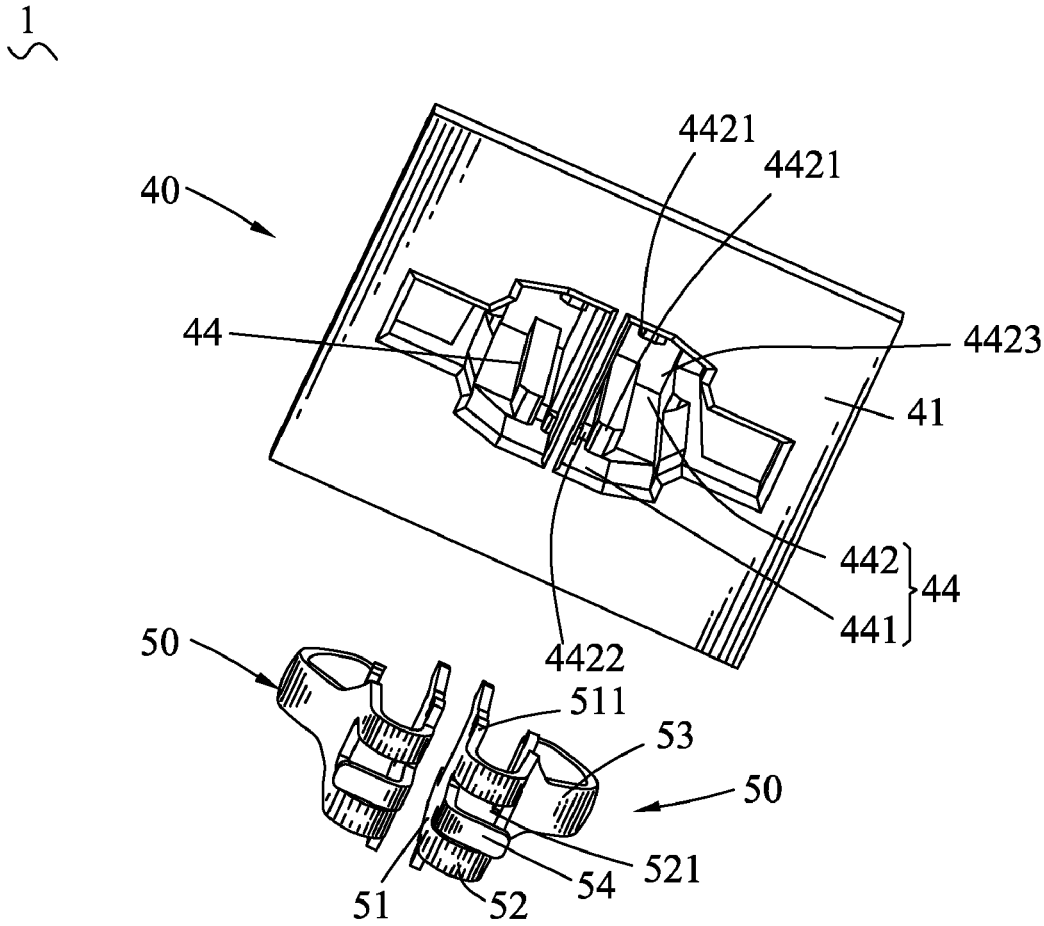
FIG. 5 is an exploded view of the plug connector of FIG. 4.

Referring to FIG. 5, each of the plug terminals 50 has a second base portion 51 with two protrusions 511 protruded oppositely from two lower portions of two opposite sides of the second base portion 51. A bottom end of the second base portion 51 is arced downward and then extends upward to form a connecting portion 52. A middle of a free end of the connecting portion 52 is arced transversely and away from the second base portion 51 to form a second contact portion 53. An arc-shaped opening 521 is formed in a middle of the connecting portion 52 and further extends to a middle of the bottom end of the second base portion 51. An inner end of the opening 521 extends downward and then is bent transversely to form an L-shaped second soldering portion 54 located under the opening 521.

Figure 4:
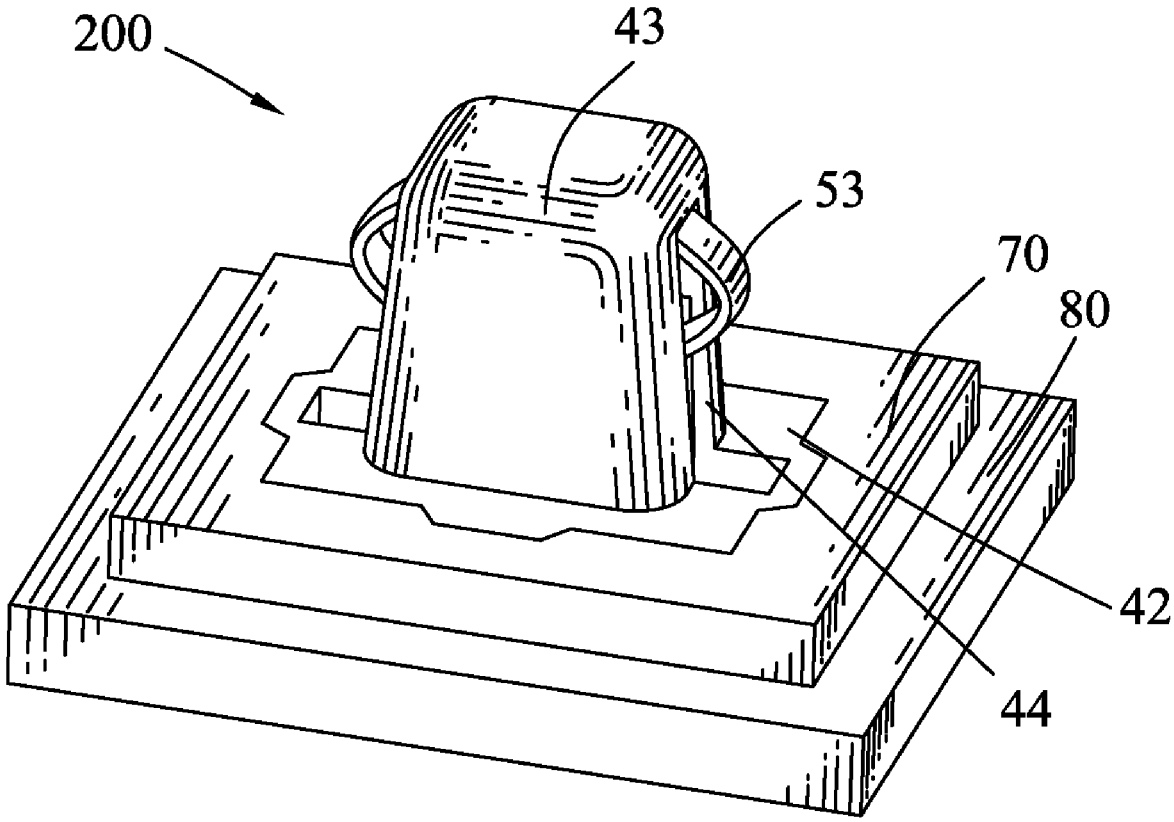
FIG. 4 is a perspective view of a plug connector of the connector assembly of FIG. 1, wherein the plug connector is mounted to a holder and soldered on a second printed circuit board of a cradle charger.
Figure 6:
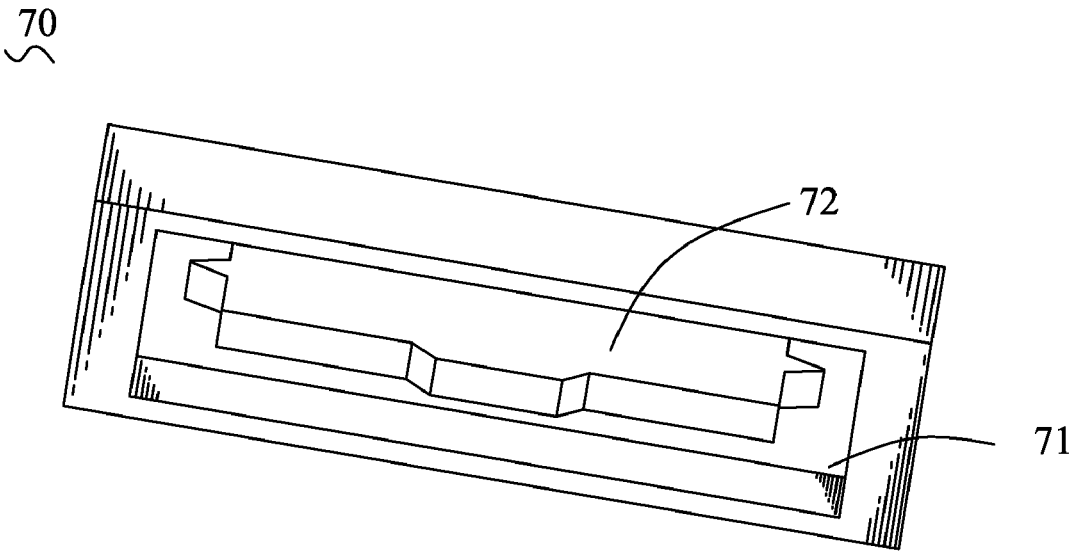
FIG. 6 is a perspective view of the holder of the cradle charger shown in FIG. 4.
Figure 7:
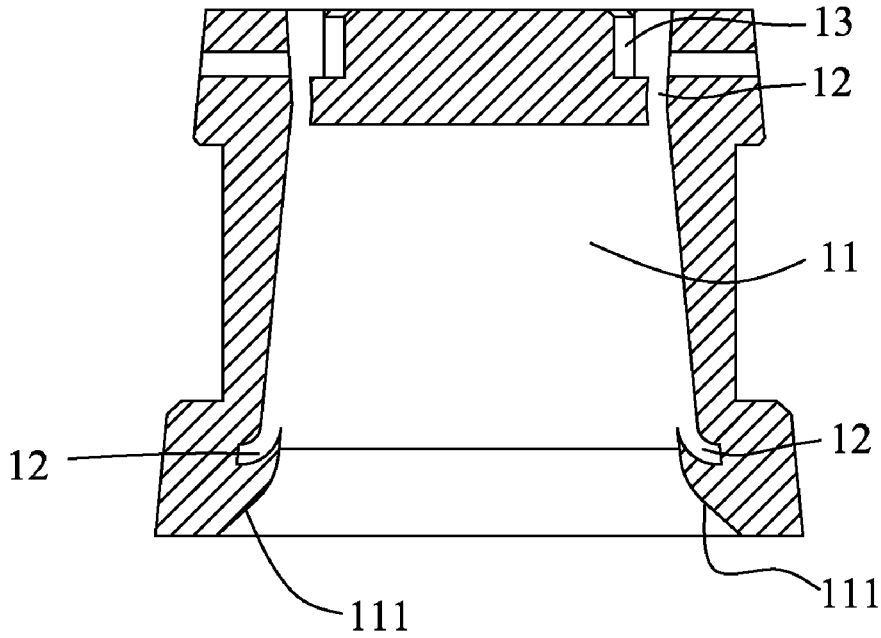
FIG. 7 is a sectional view of a socket housing of the socket connector of FIG. 3.
Figure 8:
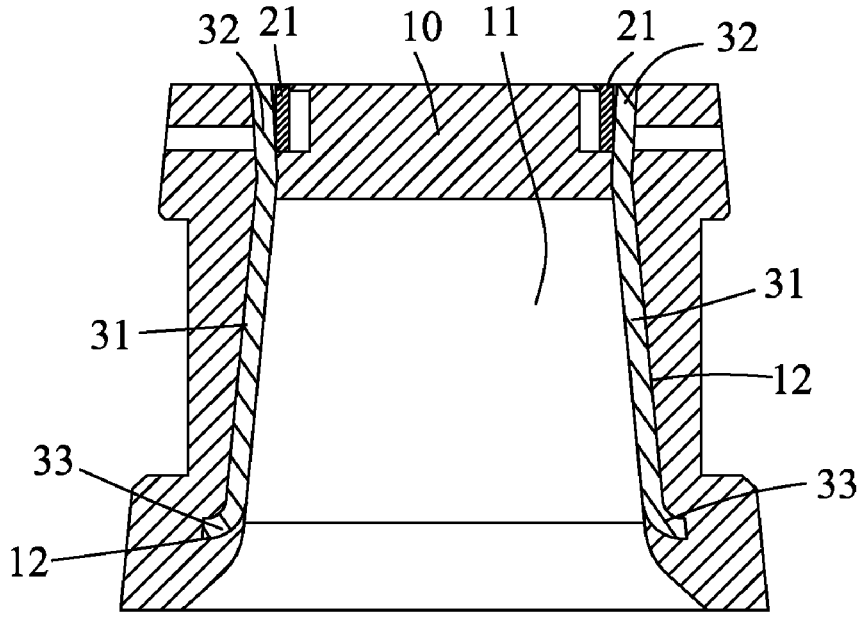
FIG. 8 is a sectional view of the socket connector of FIG. 2.
Figure 9:
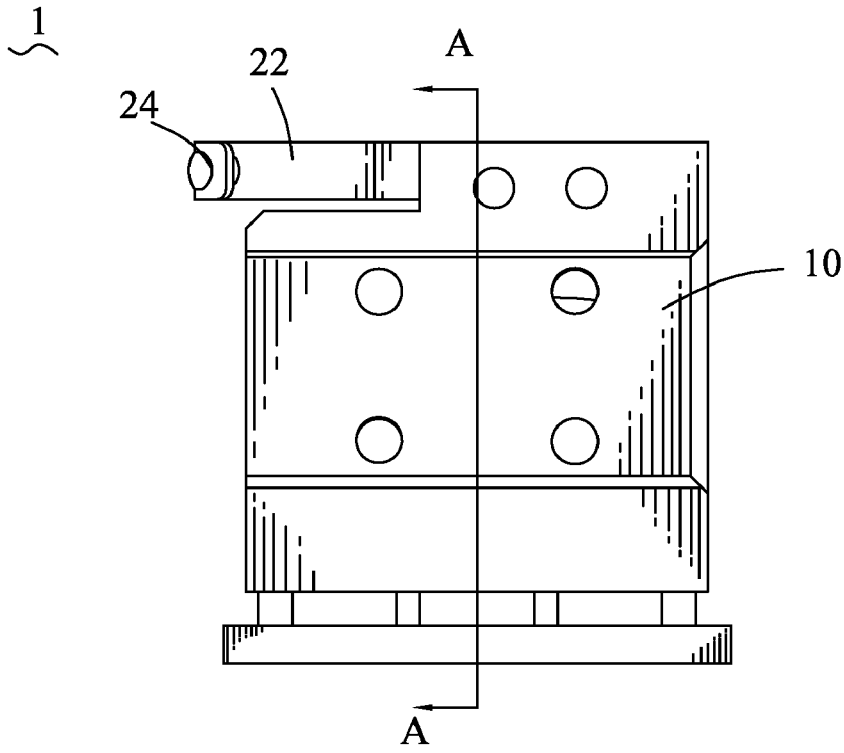
FIG. 9 is a lateral view of the connector assembly of FIG. 1.
Figure 10:
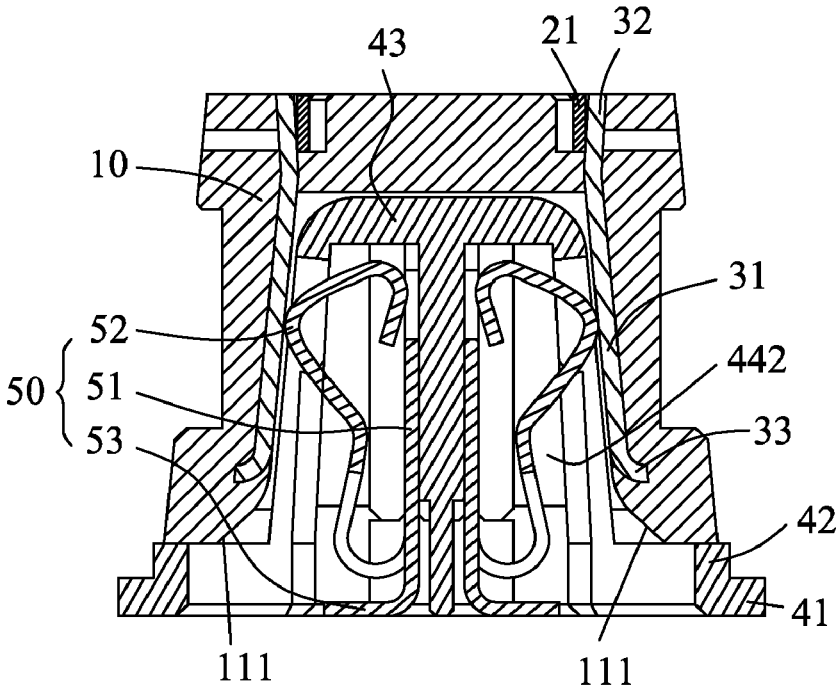
FIG. 10 is a sectional view of the connector assembly along a line A-A of FIG. 9.

Referring to FIG. 4 and FIG. 6, the holder 70 is of a rectangular board shape. A middle of a bottom of the holder 70 is cut off to define a base groove 71. A top wall of the base groove 71 defines a fixing groove 72 vertically penetrating therethrough and matched with the connecting board 42.

Referring to FIG. 4, FIG. 5, FIG. 6, FIG. 9 and FIG. 10, in assembly, the plug terminals 50 are received in the second terminal grooves 44 with the second base portions 51 being fastened in the first fastening grooves 4422, lower portions of the connecting portions 52 being received in a bottom of the receiving grooves 441, the second soldering portions 54 being projected under the base board 41 to be soldered on the second printed circuit board 80 of the cradle charger, upper portions of the connecting portions 52 received in the second fastening grooves 4423, and the second contact portions 53 projected out from the middles of the two opposite sides of the insertion head 43. Then the plug connector 200 is mounted in the cradle charger with the base board 41 being received in the base groove 71, and the connecting board 42 being received in the fixing groove 72.

Referring to FIGS. 1-10, in use, when the cell phone is charged in the cradle charger, the plug connector 200 of the cradle charger is engaged with the socket connector 100 of the cell phone. In a process of inserting the insertion head 43 of the plug housing 40 together with second base portions 51 and the second contact portions 53 of the plug terminals 50 into insertion space 11 of the inserting socket housing 10, the guiding surfaces 111 contact with two outer surfaces of two upper portions of the two second contact portions 53, and then further compress the outmost sides of the two second contact portions 53 to make the second base portions 51 and the second contact portions 53 together with the insertion head 43 slide into the insertion space 11 steadily along the guiding surfaces 111. Because the bottom of the embedding groove 12 is deeply curved into the corresponding inner sidewall of the insertion space 11 to receive the fastening pieces 33 so as to ensure a longer length of the base plates 31 exposed in the insertion space 11. So the base plates 31 have longer contact distances to contact with the second contact portions 53 to realize a better electrical connection between the socket connector 100 and the plug connector 200 to charge the cell phone in the cradle charger.

As described above, the fastening pieces 33 of the contact pads 30 are embedded in the curved bottoms of the embedding grooves 12 to make the base plates 31 smoothly connected with the guiding surfaces 111 so as to guide the second contact portions 53 together with the insertion head 43 to be inserted into the insertion space 11 successfully and steadily along the guiding surfaces 111. Furthermore, the base plates 31 exposed in the insertion space 11 have the longer contact distances to contact with second contact portions 53. So a better electrical connection is formed between the contact pads 30 of the socket connector 100 and the plug terminals 50 of the plug connector 200 to realize a charge for the cell phone by virtue of the cradle charger.

What is claimed is:

1. A connector assembly, comprising:

a socket connector adapted for being soldered on a first printed circuit board, the socket connector including:

a socket housing defining an insertion space at a lower portion thereof, at least two embedding grooves being defined in two opposite inner sidewalls of the insertion space and communicating with the insertion space, a top of the embedding groove penetrating upward through a top of the socket housing and a bottom of the embedding groove being deeply curved into the corresponding inner sidewall of the insertion space, the top of the socket housing defining at least two first terminal grooves connected with the tops of the embedding grooves respectively, two bottom edges of the two opposite inner sidewalls of the insertion space being designed with two arc-shaped guiding surfaces;

at least two socket terminals received in the first terminal grooves of the socket housing with first soldering portions thereof projecting beyond a front of the socket housing to be soldered on the first printed circuit board; and at least two contact pads inserted in the embedding grooves of the socket housing and face-to-face exposed in the insertion space, with a top end of each contact pad being fastened in the top of the corresponding embedding groove to electrically contact with the socket terminal, and a bottom end of each contact pad being bent to be embedded in the bottom of the embedding groove so as to realize a smooth connection of the contact pad and the guiding surface; and a plug connector adapted to be engaged with the socket connector and soldered on a second printed circuit board, the plug connector including:

a plug housing including a base board, a top of the base board protruding upward to form an insertion head defining at least two second terminal grooves vertically penetrating through the base board, and further oppositely passing through two opposite outsides of the insertion head; and at least two plug terminals received in the second terminal grooves, each of the plug terminals having a second contact portion arched outward to elastically project sideward out of the second terminal groove and a second soldering portion projected under the base board to be soldered on the second printed circuit board, the second contact portion together with the insertion head being inserted into the insertion space of the socket housing along the guiding surfaces to electrically contact with the contact pads.

2. The connector assembly as claimed in claim 1, wherein each contact pad has a base plate disposed in the embedding groove, a top of the base plate extends upward to form a contact piece fastened in the top of the embedding groove to contact with the socket terminal, a bottom of the base plate is bent sideward to form a fastening piece embedded in the bottom of the embedding groove, the base plates of the contact pads are disposed in the embedding grooves in one way of being slightly inclined opposite to each other from top to bottom.

3. The connector assembly as claimed in claim 1, wherein each plug terminal has a second base portion fastened in the second terminal groove, and a connecting portion bent outward and then extending upward from a bottom of the second base portion, the second contact portion is arched away from the second base portion from a free end of the connecting portion, an opening is opened in a lower portion of the connecting portion, the second soldering portion is L-shaped to be connected with an inner end of the opening and located under the opening.

4. The connector assembly as claimed in claim 1, wherein the first terminal grooves are L-shaped and apart opened in a rear of the top of the socket housing, a front of the top of the socket housing is cut off to form a passage communicating with the first terminal grooves, the socket terminal has an L-shaped first base portion secured in the first terminal groove, a substantial V-shaped elastic arm is connected with a front end of the first base portion and located in the passage, a free end of the elastic arm is curved rearward to form the first soldering portion soldered on the first printed circuit board.

5. The connector assembly as claimed in claim 1, wherein the plug housing further has a connecting board formed between the base board and the insertion head, the second terminal grooves further vertically penetrate through the connecting board.

6. The connector assembly as claimed in claim 5, further comprising a holder, a bottom of the holder being cut off to define a base groove for receiving the base board therein, a top side of the base groove being further concaved upward to form a fixing groove penetrating upward through a top of the holder for securing the connecting board of the plug housing therein.

* * * * *